US007216910B2

(12) United States Patent
Frauscher

(10) Patent No.: US 7,216,910 B2
(45) Date of Patent: May 15, 2007

(54) TONGS

(76) Inventor: Jasmina Frauscher, Solaristrasse 9, Salzburg (AT) A 5020

( * ) Notice: Subject to any disclaimer, the term of this patent is extended or adjusted under 35 U.S.C. 154(b) by 0 days.

(21) Appl. No.: 10/545,363

(22) PCT Filed: Jan. 23, 2004

(86) PCT No.: PCT/AT2004/000024

§ 371 (c)(1),
(2), (4) Date: Aug. 11, 2005

(87) PCT Pub. No.: WO2004/071255

PCT Pub. Date: Aug. 26, 2004

(65) Prior Publication Data

US 2006/0091684 A1 May 4, 2006

(30) Foreign Application Priority Data

Feb. 12, 2003 (AT) ..... GM69/2003

(51) Int. Cl.
*B25B 9/02* (2006.01)

(52) U.S. Cl. ..... 294/99.2

(58) Field of Classification Search ..... 294/99.2, 294/16, 3, 33, 8.5

See application file for complete search history.

(56) References Cited

U.S. PATENT DOCUMENTS

| | | | | |
|---|---|---|---|---|
| 1,260,302 A | | 3/1918 | Barrows | |
| 1,765,974 A | * | 6/1930 | Foltis | 30/150 |
| 3,186,749 A | * | 6/1965 | Dawes | 294/99.2 |
| 3,304,111 A | * | 2/1967 | Kauh et al. | 294/99.2 |
| 4,012,068 A | | 3/1977 | Apodaca | |
| 4,199,180 A | | 4/1980 | Kelly | |
| 4,576,408 A | * | 3/1986 | Maneki | 294/99.2 |
| 4,787,663 A | * | 11/1988 | Laramie | 294/99.2 |
| 4,809,435 A | * | 3/1989 | Printz | 30/142 |
| 5,054,835 A | | 10/1991 | Loechel et al. | |
| 5,911,462 A | * | 6/1999 | Hui | 294/99.2 |
| 6,454,328 B1 | * | 9/2002 | Barillos | 294/16 |

FOREIGN PATENT DOCUMENTS

| | | | |
|---|---|---|---|
| DE | 442 855 B | | 4/1927 |
| DE | 75 02 395 U | | 5/1975 |
| DE | 20 103 805 U | | 8/2001 |
| JP | 10 225361 A | | 8/1998 |
| JP | 2001/269908 | | 10/2001 |
| WO | WO 97/41762 | * | 11/1997 |

* cited by examiner

*Primary Examiner*—Dean J. Kramer
(74) *Attorney, Agent, or Firm*—Collard & Roe, P.C.

(57) ABSTRACT

The invention relates to a simple method for producing tongs (1) and to a tong (1) comprising two arms (2) consisting of wooden material that can be elastically bent in relation to one another, said arms (2) being rigidly inserted into a head piece (3) at an angle to on another. To obtain an advantageous construction, each arm (2) is inserted into a respective groove of the wooden head piece (3), said V-shaped grooves being angled towards one another and both arms are connected to the head piece (3) in a permanent manner.

4 Claims, 1 Drawing Sheet

TONGS

CROSS REFERENCE TO RELATED APPLICATIONS

Applicant claims priority under 35 U.S.C. §119 of Austrian Application No. GM 69/2003 filed Feb. 12, 2003. Applicant also claims priority under 35 U.S.C. §365 of PCT/AT04/000024 filed Jan. 23, 2004. The international application under PCT article 21(2) was not published in English.

1. Field of the Invention

The invention refers to a tong comprising two converging arms consisting of elastically bendable wooden material and rigidly inserted into a head piece.

2. Description of the Prior Art

In order to seize food, tongs are known (DE 442 855 B) comprising two arms consisting of elastically bendable wooden material, which are inserted into a hollow conical head piece made of metal. Due to the form of the head piece and due to a cross strut at the open end of the cone surface area, the arms are rigidly inserted into the head piece at an angle to each other. However, a disadvantage about this tong is that the tong arms are easily detachable, since they fit only over small bearing surfaces inside the head piece. Repeated use leads soon to an increase of the axial play, so that the necessary rigid support is no longer given. In addition, the production of a conical head piece is complex and costly, in addition to which a cross strut needs to be introduced at the open end of the cone surface area.

Furthermore, tongs are known (U.S. Pat. No. 5,054,835 B) which have serving members held together with a head piece designed as a sleeve. The serving members are inserted into the head piece in parallel and this head piece holds the serving members together with a snap-fitting engagement. A disadvantage with using these tongs is, that with a reduction of the spring force of the snap-fitting engagement, a release of the serving members from the head piece may take place when holding food. In addition, the spring force of the snap-fitting engagement does not provide a rigid support of the serving members in the head piece, that gives a feeling of a sensitive holding of the food with the tong arms. Also, regenerating materials, like wooden materials, can be used for the head piece only at high production expenditure, which doesn't allow economical manufacturing of such tongs.

Other tongs (DE 75 02 395 U) consist of a head piece and two serving members. Thus a head piece is shown (FIG. 9), which has two serving members rigidly inserted at an angle to each other. For this purpose, two hole-like recesses, such as bores, pass through the whole head piece. In these recesses, the serving members are inserted. A disadvantage is, that the bending forces the serving members exert upon the head piece have to be taken up by the head piece parts lateral to the bores, which demands an increased expenditure of material. Also, the width of the head piece has to be larger than the width of the tong arms, therefore narrow tongs can't be produced with such a head piece. In addition, a rectangular recess is comparatively difficult to produce in a wooden head piece.

SUMMARY OF THE INVENTION

It is one object of the present invention to improve a tong as well as to improve a production of a tong, in such a manner that despite a high load capacity of the tongs the tongs can be produced economically from regenerating materials. In addition the tong should distinguish to other tongs in ability of recycling and in smallest dimensions.

The object is achieved by the present invention in such a way that each arm is inserted into a respective groove of the wooden head piece, the grooves converging towards each other to form a V-shape, and both arms are connected to the head piece in a permanent manner.

As the tong arms are inserted into a respective groove of the head piece, the V-shaped grooves converging towards each other, the tong arms rigidly support themselves over large enough bearing surfaces in the head piece, which avoids axial play even with frequent bending of the tong arms. Therefore less resistant materials, for example wood materials, can be used, without a danger of detaching the tong arms from the head piece. In order to prevent also a lateral shifting of the tong arms in the respective groove, the tong arms are connected in a permanent manner with the head piece. Since now the entire tong can be manufactured from wooden material, a complex recycling technique for the tongs is not needed, what allows the tongs to act as a one-way tong. As it is possible to choose the width of the head piece equally to the width of the tong arms, a decrease of the expenditure for material and the production of slim tongs are possible.

With grooves located in the front part of the tongs inside the tong arms, food can be gripped more securely by the tongs.

If each tong arm carries a descending ramp on its inside, coherent food may be more easily separated. Also, food can be better seized by putting the tong arms underneath the food.

With providing grooves in the head piece of the tong, a particularly simple and economical manufacture of a tong from wooden material is possible. Thus in a first step, an elastically bendable wooden plate is inserted into a respective groove of a wooden strip, the grooves converging towards each other and both plates are connected to the strip in a permanent manner. In a further step, the tongs are separated by a cut across the strip with the permanently connected plates.

BRIEF DESCRIPTION OF THE DRAWINGS

The subject matter of the invention is shown by the way of example in the drawings.

DESCRIPTION OF THE PREFERRED EMBODIMENT

Figure 1:
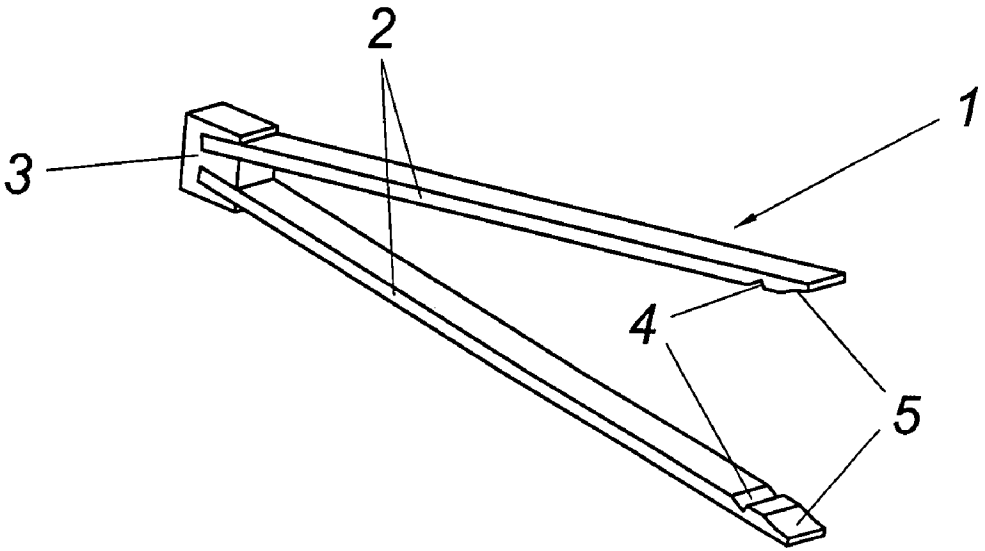
FIG. 1 shows a tong according to invention in perspective view.
Figure 2:
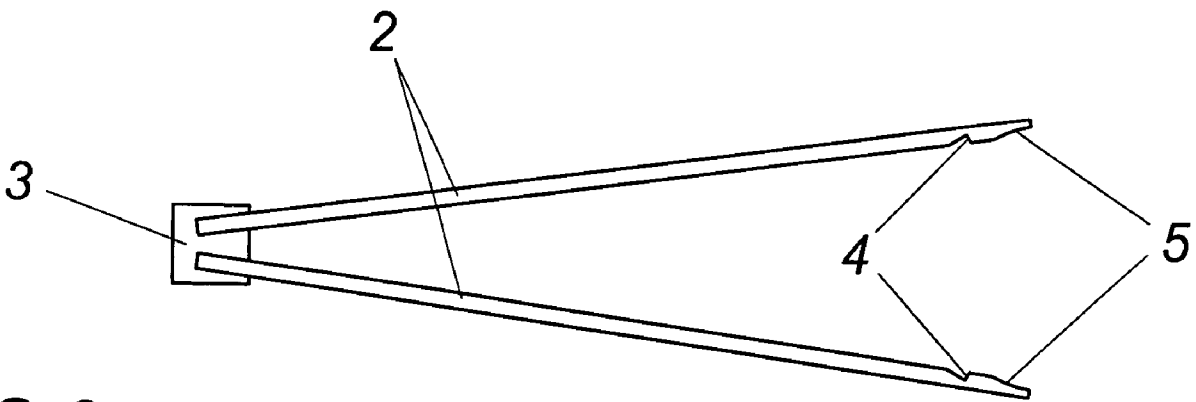
FIG. 2 is a side view of FIG. 1.

According to the illustrated embodiment, the tong 1 (FIG. 1, FIG. 2) comprises two arms 2 consisting of wooden material that can be elastically bent and a wooden head piece 3. The tong arms 2 are rigidly inserted into a groove of head piece 3 at an angle to each other. The separate grooves of the wooden head piece 3 converge towards each other (FIG. 2) to form a V-shape. The grooves form a web in the head piece 3 of sufficient strength. In order to prevent a shifting of the tong arms 2 in the respective groove, the tong arms 2 are connected to the head piece 3 in a permanent manner, for example with glue.

The tong 1 has grooves 4 located in the open front part of the tong 1 on the inside of tong arms 2. Also on the inside each tong arm 2 has a ramp 5 descending to the jaw of the tong 1, in order to improve seizing of food. In addition, the head piece 3 width is the same as that of the tong arms 2, so that the tong is particularly comfortable 1 in its handling.

Since the head piece 3 is made of wood material, the head piece 3 can be favourably separated from a strip in which two grooves are milled. The tong arms 2 must only be inserted then into the head piece 3. However especially easy and economical is the production of the tongs 1 by a technique in which a separation cut is effected after insertion of the tong arms 2 into the head piece 3.

The invention claimed is:

1. A tong comprising a head piece having a width and consisting of wooden material, the head piece having two grooves extending transversely therethrough in the direction of the width from one side of the head piece to the other, the grooves converging towards each other to form a V-shape, and two arms having the same width as the width of the head piece and consisting of wooden material elastically bendable in relation to one another, the arms having one end rigidly inserted in the grooves and connected to the head piece in a permanent manner to form converging arms.

2. The tong of claim 1, wherein the inside of the ends of the arms opposite the one end have transversely extending grooves.

3. The tong of claim 1, wherein the inside of the ends of the arms opposite the one end have descending ramps.

4. A method for producing tongs, which comprises a first step of rigidly inserting two elastically bendable plates consisting of a wooden material into two grooves in a strip consisting of a wooden material, the two grooves extending along the length of the strip and converging to form a V-shape, and connecting the plates to the strip in a permanent manner to form converging plates, and a second step of dividing the strip with the permanently connected plates into respective ones of the tongs by cuts across the strip and plates.

* * * * *